US010280676B2

(12) United States Patent
Li et al.

(10) Patent No.: US 10,280,676 B2
(45) Date of Patent: May 7, 2019

(54) VEHICLE WINDOW LIFT CONTROL SYSTEM AND CONTROL METHOD

(71) Applicant: JOHNSON ELECTRIC INTERNATIONAL AG

(72) Inventors: Yue Li, Hong Kong (CN); Jing Xin Shi, Shenzhen (CN); Yong Gang Li, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 34 days.

(21) Appl. No.: 15/446,292

(22) Filed: Mar. 1, 2017

(65) Prior Publication Data

US 2017/0254136 A1 Sep. 7, 2017

(30) Foreign Application Priority Data

Mar. 1, 2016 (CN) ..... 2016 1 0116816

(51) Int. Cl.

| | |
|---|---|
| ***E05F 15/40*** | (2015.01) |
| ***E05F 15/75*** | (2015.01) |
| ***E05F 15/695*** | (2015.01) |
| ***E05F 15/697*** | (2015.01) |

(52) U.S. Cl.

CPC ..... *E05F 15/75* (2015.01); *E05F 15/40* (2015.01); *E05F 15/695* (2015.01); *E05F 15/697* (2015.01); *E05Y 2201/434* (2013.01); *E05Y 2400/32* (2013.01); *E05Y 2400/334* (2013.01); *E05Y 2900/55* (2013.01)

(58) Field of Classification Search

CPC ..... E05F 15/75
USPC ..... 318/280, 34
See application file for complete search history.

(56) References Cited

U.S. PATENT DOCUMENTS

| | | | | |
|---|---|---|---|---|
| 5,689,160 | A * | 11/1997 | Shigematsu | H02H 7/0851 318/281 |
| 6,822,410 | B2 * | 11/2004 | Whinnery | G05B 19/232 318/266 |
| 8,826,592 | B2 * | 9/2014 | Katayama | E05F 11/445 49/26 |

* cited by examiner

*Primary Examiner* — David Luo
(74) *Attorney, Agent, or Firm* — Muncy, Geissler, Olds & Lowe, P.C.

(57) ABSTRACT

A vehicle window lift control system includes a window lift motor, a motor drive/control module, an inverter, a rotor position sensing unit, and an anti-pinch module. The window lift motor is a brushless direct current motor. The anti-pinch module detennines whether or not the vehicle window is in an anti-pinch area based on position feedback signals generated by a rotor position sensing unit that is inherently included in the brushless direct current motor. When the vehicle window is in the anti-pinch area, an obstacle judgment unit is initiated. When there is an obstacle, an anti-pinch instruction unit sends an anti-pinch instruction to the motor drive/control module, and the motor drive/control module drives the inverter according to the anti-pinch instruction to make the motor rotate reversely. The present vehicle window lift control system has the advantages of small size, low failure rate and low cost.

15 Claims, 5 Drawing Sheets

VEHICLE WINDOW LIFT CONTROL SYSTEM AND CONTROL METHOD

CROSS REFERENCE TO RELATED APPLICATIONS

This non-provisional patent application claims priority under 35 U.S.C. § 119(a) from Patent Application No. 201610116816.X filed in The People's Republic of China on Mar. 1, 2016.

FIELD OF THE INVENTION

This invention relates to a vehicle window lift control system and its control method, and in particular to a vehicle window lift control system with an anti-pinch function and its control method.

BACKGROUND OF THE INVENTION

Many cars are equipped with electric windows to facilitate opening and closing of the windows. Opening and closing of the electric windows are achieved through a vehicle window lift mechanism. The vehicle window lift mechanism typically includes a motor and an associated transmission assembly. However, traditionally, the motor for driving the vehicle window is usually a brushed motor including components such as a stator, a rotor, brushes, and the like, which leads to a relatively large motor size. In addition, as the motor operates, a commutator connected with the rotor and the brushes produce a mutual friction therebetween, which causes the brushes to be easily worn. Therefore, the electric vehicle windows utilizing the brushed motor have a high failure rate and short lifespan. In addition, current electric vehicle windows usually need to include an auto-lift system, and the electric vehicle windows including the auto-lift system need to have an anti-pinch function. Therefore, a switch-type Hall sensor needs to be installed to determine the position of the vehicle window, which greatly dilutes the cost advantages of utilizing the brushed motor.

SUMMARY OF THE INVENTION

Accordingly, there is a need for a vehicle window lift control system having a relatively smaller size, lower failure rate and reasonable cost, and a vehicle window lift control method.

A vehicle window lift control system for controlling lifting up or lowering down of a vehicle window includes a window lift motor, a motor drive/control module, an inverter, and a rotor position sensing unit. The window lift motor is a brushless direct current motor. The motor drive/control module is configured to drive the inverter to thereby control rotation of the window lift motor based on a rotor position feedback signal obtained by the rotor position sensing unit. The vehicle window lift control system further includes an anti-pinch module. The anti-pinch module includes a pulse counter, a count comparator, an obstacle judgment unit, and an anti-pinch instruction unit. The pulse counter is configured to record the number of pulses generated by the rotor position sensing unit during lifting up of the vehicle window. The count comparator is configured to compare the recorded number of the pulses against a preset threshold to determine whether or not the vehicle window is in an anti-pinch area. The obstacle judgment unit is initiated when it is determined that the vehicle window is in the anti-pinch area. When the obstacle judgment unit determines that there is an obstacle, the anti-pinch instruction unit sends an anti-pinch instruction to the motor drive/control module, and the motor drive/control module drives the inverter according to the anti-pinch instruction to make the motor rotate reversely.

A vehicle window lift control method includes the steps of: providing a brushless direct current motor for driving a vehicle window to lift up or lower down; operating the brushless direct current motor according to an external command and a motor position feedback signal; determining whether or not the vehicle window is in an anti-pinch area according to the rotor position feedback signal; determining whether or not the lifting vehicle window meets an obstacle according a motor operating parameter when it is determined that the vehicle window is in the anti-pinch area; and controlling the motor to perform an anti-pinch operation when it is determined that the lifting vehicle window meets an obstacle.

The vehicle window lift control system of the present invention utilizes the brushless direct current motor, and the anti-pinch operation is performed based on the position feedback signals generated by the rotor position sensing unit that is inherently included in the brushless direct current motor. Therefore, the present vehicle window lift control system has a smaller size, lower failure rate and reasonable cost.

DETAILED DESCRIPTION OF THE PREFERRED EMBODIMENTS

The present invention will now be described further, by way of example only, with reference to the accompanying drawings.

Figure 1:
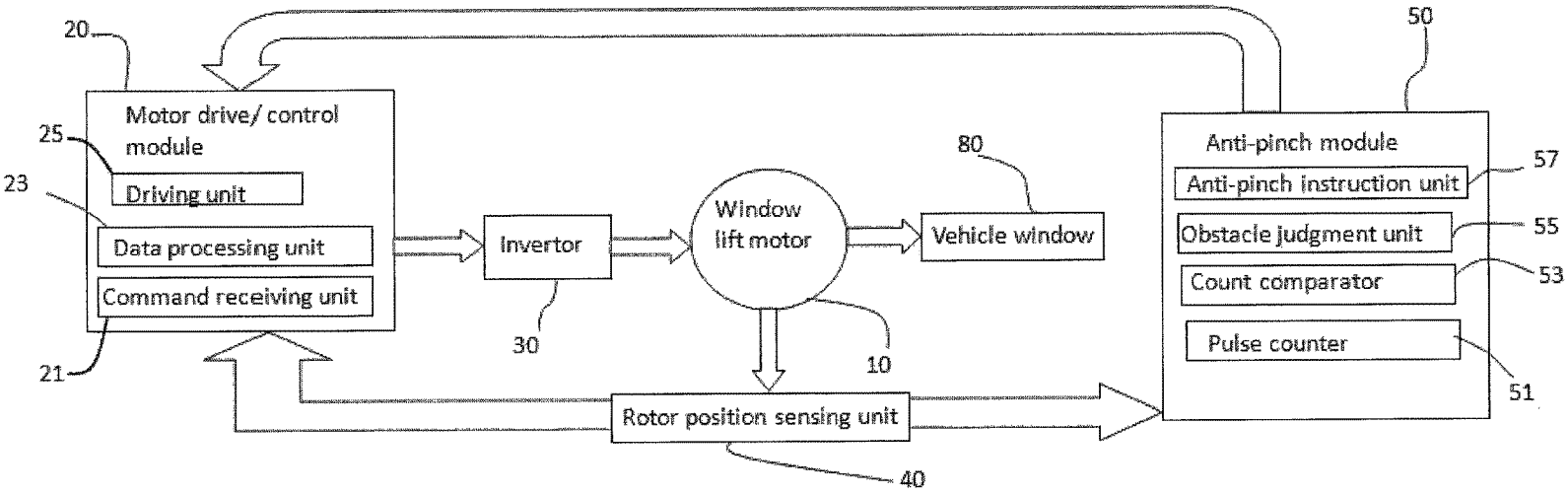
FIG. 1 is a block diagram of a vehicle window lift control system according to one embodiment of the present invention.
Figure 2:
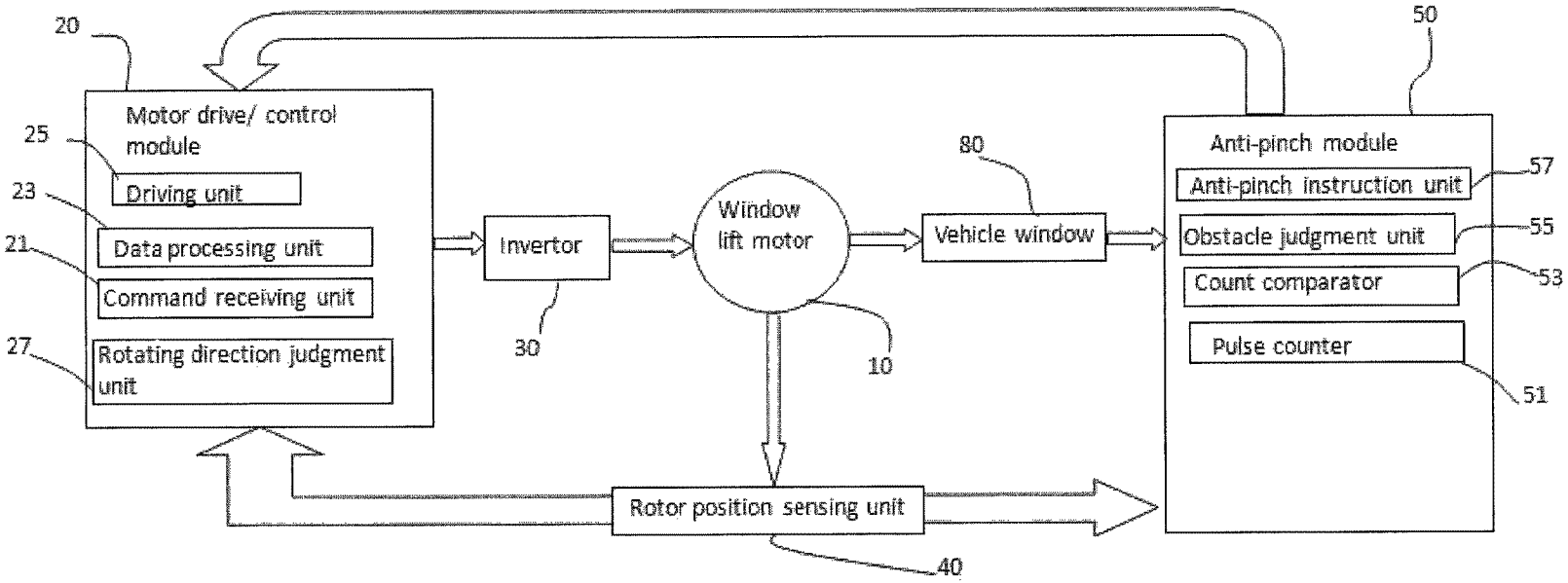
FIG. 2 is a block diagram of a vehicle window lift control system according to another embodiment of the present invention.

Referring to FIG. 1, a vehicle window lift control system of the present invention is used to control a vehicle window 80 to lift up or lower down. The vehicle window lift control system includes a window lift motor 10, a motor drive/control module 20, an inverter 30, a rotor position sensing unit 40, and an anti-pinch module 50.

The window lift motor 10 is a three-phase or single-phase brushless direct current motor. The window lift motor 10 is connected to the vehicle window 80 through a transmission assembly including a gearbox, traction cables, and the like, such that power outputted from a rotary shaft of the window lift motor 10 is transmitted to the vehicle window 80 to form a traction force for driving the vehicle window 80 to lift up or lower down.

The motor drive/control module 20 is configured to receive and execute an external command, and have the functions of data processing and driving the inverter 30. The motor drive/control module 20 includes a command receiving unit 21, a data processing unit 23, and a driving unit 25. The command receiving unit 21 receives an external command, such as an instruction of lifting up, lowering down or stopping the vehicle window that is inputted through a button or a trigger. The data processing unit 23 performs data processing according to the received command to obtain a corresponding motor control signal. The driving unit 25 obtains a regular driving signal according to the motor control signal and drives the inverter 30 to supply or cut off power to various windings of the window lift motor 10, thereby starting the motor 10 in a desired direction or stopping the motor 10.

Since the window lift motor 10 is a brushless direct current motor, in order to ensure continuous operation of the window lift motor 10, the rotor position sensing unit 40 is required to detect a position of the motor rotor, and upon the motor rotor 50 rotating over a preset position, the motor drive/control module 20 drives the inverter 30 to make the motor 10 run continuous. Specifically, the data processing unit 23 of the motor drive/control module 20 is connected to the rotor position sensing unit 40 to receive a position feedback signal from the rotor position sensing unit 40. The data processing unit 23 generates commutation instruction according to the position feedback signal, and the driving unit 25 drives the inverter 30 to perform proper commutation, thereby ensuring continuous rotation of the window lift motor 10 and hence achieving the control of automatic lifting up or lowering down of the vehicle window 80. The rotor position sensing unit 40 includes one or more switch-type Hall sensors. Each of the switch-type Hall sensors generates a continuous square wave signal as the motor operates.

In one embodiment, the motor drive/control module 20 further includes a rotation direction judgment unit 27 to judge a motor actual rotating direction and judge whether the motor actual rotating direction is consistent with the control command received by the command receiving unit 21, and generate a failure signal when the motor actual rotating direction is inconsistent with the control command It is noted that, when the rotation direction judgment unit 27 is included, the rotor position sensing unit 40 includes at least two switch-type Hall sensors, and the rotation direction judgment unit 27 judges the motor rotating direction according to a sequence of two square wave signals generated by the two switch-type Hall sensors.

Specifically, when the window lift motor 10 is a three-phase brushless direct current motor, the rotor position sensing unit 40 includes three switch-type Hall sensors. The three switch-type Hall sensors detect the position of the motor rotor relative to the stator winding of each of three phases. Therefore, positions of two adjacent switch-type Hall sensors have a 120-degree electric angle difference therebetween. the motor actual rotating direction can be judged according to a sequence of the square wave signals generated by any two or all of the three switch-type Hall sensors. When the window lift motor 10 is a single phase brushless direct current motor, the rotation direction judgment unit 27 is not included, and the rotor position sensing unit 40 needs only one switch-type Hall sensor. Of course, as noted above, when the rotation direction judgment unit 27 is included, two switch-type Hall sensors are needed, one of which is used to operate the motor, and both of which are used in combination to judge the motor rotating direction.

Figure 3:
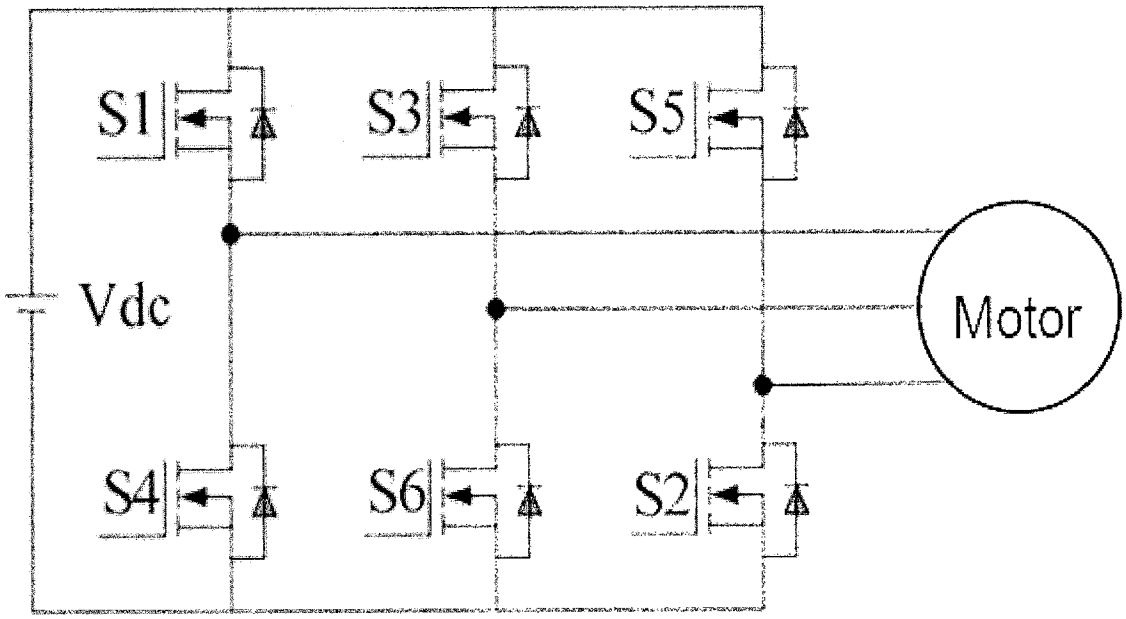
FIG. 3 is a circuit diagram of the inverter of FIG. 1.
Figure 4:
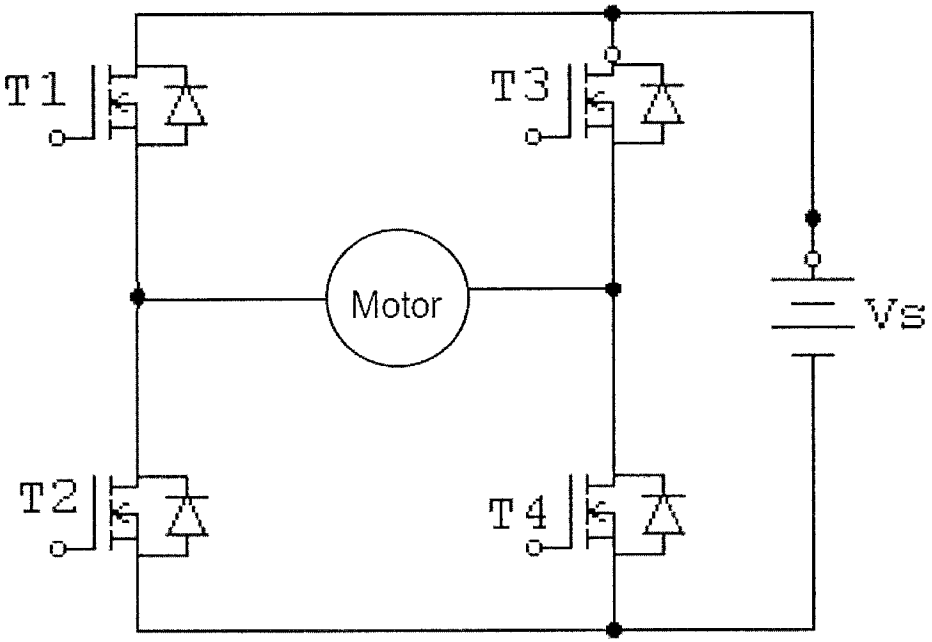
FIG. 4 is a circuit diagram of the inventor of FIG. 1 according to another embodiment.

The inverter 30 is a bridge switch circuit. Referring to FIG. 3, when the three-phase brushless direct current motor is used, the bridge switch circuit is typically a three-phase bridge switch circuit having six power transistor switches. Referring to FIG. 4, when the single-phase brushless direct current motor is used, the bridge switch circuit is typically an H-bridge switch circuit having four transistor switches. The power transistor switches may be metal-oxide-semiconductor field-effect transistors (MOSFETs).

The anti-pinch module 50 includes a pulse counter 51, a count comparator 53, an obstacle judgment unit 55, and an anti-pinch instruct unit 57. Since the rotor position sensing unit 40 includes one or more switch-type Hall sensors, the rotor position sensing unit 40 generates square wave pulse signals as the motor rotor rotates. The number of the pulses is directly proportional to rotation turns of the rotor. The transmission module has a fixed reduction ratio. Therefore, the number of the pulses linearly corresponds to a position of the vehicle window, and the position of the vehicle window can be determined by recording the number of the pulses. In one embodiment, the window lift motor 10 is a three-phase brushless direct current motor, the rotor position sensing unit 40 includes three switch-type Hall sensors, and the pulse counter 51 are used to record the number of the pulses generated by the three switch-type Hall sensors during lifting up of the vehicle window 80. In another embodiment, the vehicle window 80 is a single-phase brushless direct current motor, the rotor position sensing unit 40 includes two switch-type Hall sensors, and the pulse counter 51 is used to record the number of the pulses generated by one of the two switch-type Hall sensors during lifting up of the vehicle window 80. The count comparator 53 is used to compare the number of the pulses recorded in the pulse counter 51 against a predetermined threshold, and determine whether or not the vehicle window is in an anti-pinch area according to a relationship between the recorded number of the pulses and the threshold. For example, the threshold includes a threshold upper limit and threshold lower limit. When the recorded number of the pulses falls between the threshold upper limit and the threshold lower limit, it is determined that the vehicle in window is in the anti-pinch area, such that the obstacle judgment unit 55 is initiated.

The obstacle judgment unit 55 can determine whether the lifting vehicle window meets an obstacle by measuring at least one of a motor speed, a current of the motor windings and a motor output torque and comparing the measured parameter against a preset threshold. A width of the pulses generated by the rotor position sensing unit 40 has a positive correlation with the rotation speed of the window lift motor 10 and can therefore be used to indicate the motor speed. In one embodiment, the obstacle judgment unit 55 includes a pulse width recorder and a pulse width comparator. The pulse width recorder is used to record the width of the pulses generated by the rotor position sensing unit 40. The pulse width comparator is used to compare the recorded pulse width against a preset threshold. When the recorded pulse width is greater than the preset threshold, the obstacle judgment unit 55 determines that there is an obstacle. When the vehicle window 10 is a three-phase brushless direct current motor, the rotor position sensing unit 40 includes three switch-type Hall sensors, and the pulse width recorder is used to record the width of the pulses generated by one of the switch-type Hall sensors. When the vehicle window 10 is a single-phase brushless direct current motor, the rotor position sensing unit 40 includes two switch-type Hall sensors, the pulse width recorder is used to record the width of the pulses generated by one of the switch-type Hall sensors.

The anti-pinch instruction unit 57 is connected to the motor drive/control module 20. When the obstacle judgment unit 55 judges that there is an obstacle, the anti-pinch instruction unit 57 generates an anti-pinch instruction, and the data processing unit 23 of the motor drive/control module 20 performs data processing according to the anti-pinch instruction to obtain a corresponding anti-pinch control signal. The driving unit 25 of the motor drive/control module 20 generates an anti-pinch driving signal according to the anti-pinch control signal and drives the inverter 30 to perform the anti-pinch operation, making the window lift motor 10 rotate reversely.

Figure 5:
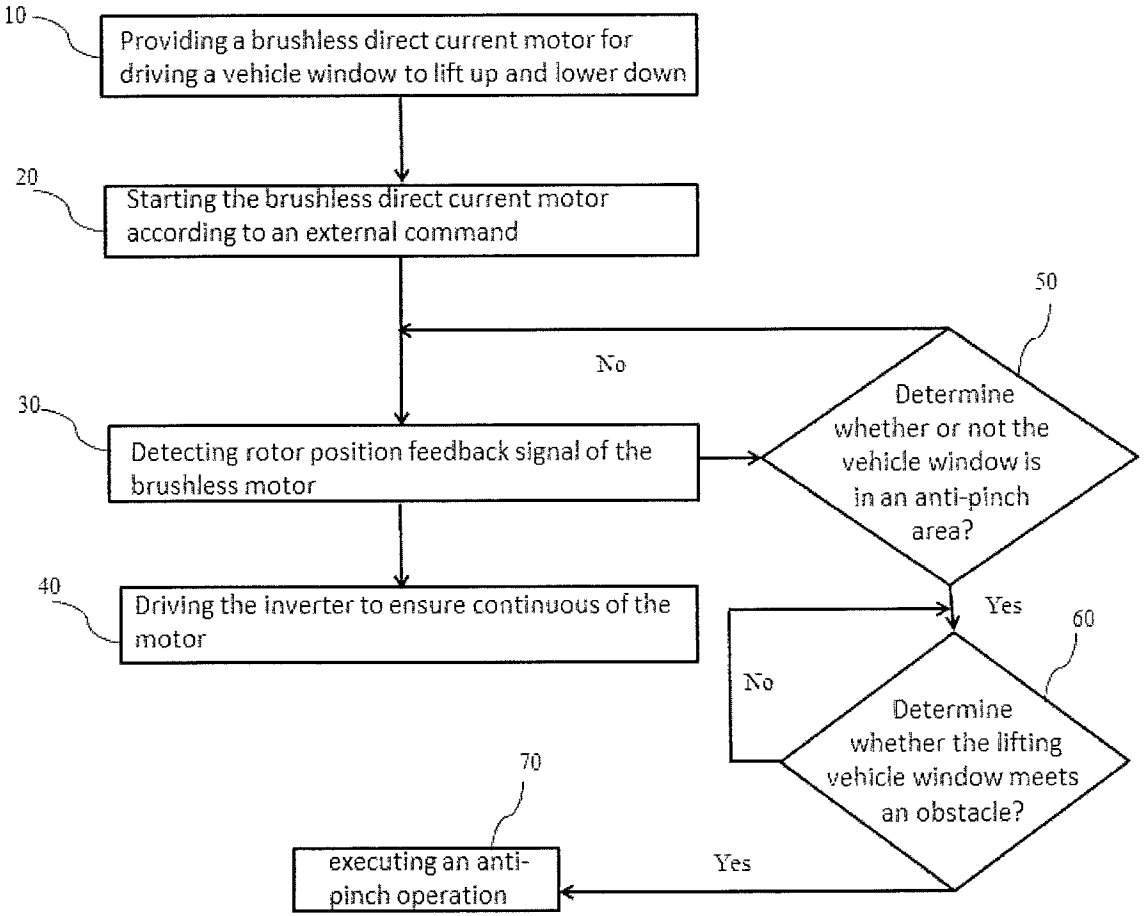
FIG. 5 is a flow chart of a vehicle window lift control method according to one embodiment.

Referring to FIG. 5, a vehicle window lift control method according to one embodiment of the present invention includes the following steps.

S10: a brushless direct current motor is provided to drive the vehicle window to lift up or lower down.

A rotary shaft of the brushless direct current motor is connected to the vehicle window through a transmission mechanism. The window lift motor is connected to the vehicle window through a transmission assembly including a gearbox, traction cables and the like, such that power outputted from the rotary shaft of the window lift motor is transmitted to the vehicle window to form a traction force to drive the vehicle window to lift up or lower down. An external power supply supplies power to the brushless direct current motor through an inverter.

S20: the brushless direct current motor is started in a desired direction or stopped according to an external command. The step S20 includes the following steps:

S21: a data processing is perfoiiiied according to an external command to obtain a corresponding motor control instruction. The external command includes an instruction of lifting up, lowering down or stopping the vehicle window that is inputted through a vehicle window button.

S22: Inverter is driven according to the motor control instruction to supply or cut off power to various windings of the brushless direct current motor, thereby starting the motor in a desired direction or stopping the motor.

S30: Rotor position is detected with a rotor sensing unit, a motor actual rotating direction is determined according to a sequence of the position feedback signals, and the actual rotating direction is compared against a rotating direction controlled by the control signal. If the two rotating directions are inconsistent, a failure signal is generated.

S40: The inverter is driven to ensure continuous running of the motor according to rotor positon feedback signals.

S50: it is deteiiiiined whether or not the vehicle window is in an anti-pinch area.

The step S50 includes the following steps:

S51: the number of the position feedback signals is recorded. In one embodiment, recording the number of the position feedback signals is performed using a counter to record the number of the square wave pulses.

S52: the recorded number of the position feedback signals is compared against a preset threshold, and whether or not the vehicle window is in the anti-pinch area is determined according to the relationship between the number of the position feedback signals and the preset threshold. In one embodiment, the preset threshold has a threshold upper limit and a threshold lower limit. When the number of the feedback signals falls between the threshold upper limit and the threshold lower limit, it is determined that the vehicle window is in the anti-pinch area.

S60: it is determined whether or not the lifting vehicle window meets an obstacle when it is determined that the vehicle window is in the anti-pinch area.

The step S60 includes the following steps.

S61: an operational parameter of the brushless direct current motor is detected. The parameter includes any one or more of a motor rotating speed, a current of the motor windings, and a motor output torque. When the feedback signals generated by the rotor position sensing unit are square wave pulse signals, a pulse width of the pulse signals can be used to indicate the motor rotating speed. In one embodiment, this step records the width of the pulses generated by the position sensing unit.

S62: the detected operational parameter of the brushless direct current motor is compared against a preset threshold, and whether or not the lifting vehicle window meets an obstacle is determined according to the relationship between the detected operational parameter of the brushless direct current motor and its corresponding threshold. In one embodiment, the recorded width of the pulses generated by the position sensing unit is compared against a threshold of the pulse width. It is determined that there is an obstacle when the recorded width of the pulses generated by the position sensing unit is greater than the threshold.

S70: when it is determined that there is an obstacle, the motor is controlled to perform an anti-pinch operation.

The step S50 comprises the following steps:

S51: when it is determined that there is an obstacle, an anti-pinch instruction is generated.

S52: a corresponding anti-pinch control signal is obtained by data processing according to the anti-pinch instruction.

S53: according to the anti-pinch control signal, a driving signal is generated which is used to drive the inverter to perform the anti-pinch operation. The anti-pinch operation includes making the brushless direct current motor rotate reversely.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated herein should not be interpreted as limits to the present invention, and the scope of the invention is to be determined by reference to the claims that follow.

The invention claimed is:

1. A vehicle window lift control system for controlling lifting up or lowering down of a vehicle window, the vehicle window lift control system comprising:

a window lift motor which is a brushless direct current motor;

an inverter;

a rotor position sensing unit;

a motor drive/control module configured to drive the inverter to enable an operation of the window lift motor based on a rotor position feedback signal obtained by the rotor position sensing unit; and an anti-pinch module comprising:

a pulse counter configured to record the number of pulses generated by the rotor position sensing unit during lifting up of the vehicle window;

a count comparator configured to compare the recorded number of the pulses against a preset threshold to determine whether or not the vehicle window is in an anti-pinch area;

an obstacle judgment unit configured to be initiated when it is determined that the vehicle window is in the anti-pinch area; and an anti-pinch instruction unit configured to send an anti-pinch instruction to the motor drive/control module when the obstacle judgment unit determines that there is an obstacle, and the motor drive/control module configured to drive the inverter according to the anti-pinch instruction to make the window lift motor rotate reversely.

2. The vehicle window lift control system of claim 1, wherein the obstacle judgment unit is configured to determine whether or not there is an obstacle by measuring one of the at least one of parameters selected from a motor speed, a current of motor windings, and a motor output torque and comparing the measured parameter against a corresponding threshold.

3. The vehicle window lift control system of claim 1, wherein the obstacle judgment unit further comprises a pulse width recorder and a pulse width comparator, the pulse width recorder is configured to detect a width of the pulses generated by the rotor position sensing unit, the pulse width comparator is configured to compare the detected pulse width against a preset pulse width threshold, and the obstacle judgment unit determines that there is an obstacle when the detected pulse width is greater than the preset pulse width threshold.

4. The vehicle window lift control system of claim 1, wherein the motor drive/control module comprises:

a command receiving unit configured to receives an external command;

a data processing unit performing data processing according to the received external command to obtain a corresponding motor control signal; and a driving unit generating a regular driving instruction according to the corresponding motor control signal to drive the inverter, thereby driving the window lift motor.

5. The vehicle window lift control system of claim 4, wherein the motor drive/control module further comprises a rotation direction judgment unit configured to detect a motor actual rotating direction, determine whether or not the motor actual rotating direction is consistent with a control command received by the command receiving unit, and generate a failure signal when the motor actual rotating direction is inconsistent with the control command.

6. The vehicle window lift control system of claim 5, wherein the rotor position sensing unit comprises at least two switch-type Hall sensors, and the rotation direction judgment unit is configured to determine the motor actual rotating direction according to a relationship between sequences of detected square wave signals that are generated by the two switch-type Hall sensors.

7. The vehicle window lift control system of claim 6, wherein the window lift motor is a single-phase brushless direct current motor, the pulse counter is configured to record the number of the pulses generated by one of said at least two switch-type Hall sensors.

8. The vehicle window lift control system of claim 1, wherein the window lift motor is a three-phase brushless direct current motor, the rotor position sensing unit comprises three switch-type Hall sensors, and the pulse counter is configured to record the number of pulses generated by the three switch-type Hall sensors.

9. The vehicle window lift control system of claim 1, wherein the window lift motor is a single-phase brushless direct current motor, the rotor position sensing unit comprises one switch-type Hall sensor, and the pulse counter is configured to record the number of pulses generated by the one switch-type Hall sensor.

10. The vehicle window lift control system of claim 1, wherein the inverter comprises a bridge switch circuit.

11. A vehicle window lift control method comprising the steps of:

providing a brushless direct current motor for driving a vehicle window to lift up or lower down;

operating the brushless direct current motor according to an external command and a motor position feedback signal;

determining whether or not the vehicle window is in an anti-pinch area according to a rotor position feedback signal, wherein the method further comprises steps of:

recording the number of rotor position feedback signals by using a counter to record the number of square wave pulses;

comparing the recorded number of the rotor position feedback signals against a preset threshold, and determining whether or not the vehicle window is in the anti-pinch area according to the relationship between the number of the rotor position feedback signals and the preset threshold;

determining whether or not the lifting vehicle window meets an obstacle according to a motor operating parameter when it is determined that the vehicle window is in the anti-pinch area; and executing an anti-pinch operation when it is determined that the lifting vehicle window meets an obstacle.

12. The vehicle window lift control method of claim 11, wherein operating the brushless direct current motor according to an external command and a motor position feedback signal comprises starting the brushless direct current motor in a desired direction or stopping the brushless direct current motor according to the external command and ensure continuous running of the brushless direct current motor according to rotor positon feedback signals.

13. The vehicle window lift control method of claim 12, wherein operating the brushless direct current motor according to the external command and the motor position feedback signal comprises determining a motor actual rotating direction according to a sequence of motor position feedback signals, and comparing the motor actual rotating direction against a rotating direction controlled by a control signal, and if the two rotating directions are inconsistent, a failure signal is generated.

14. The vehicle window lift control method of claim 11, wherein determining whether or not the lifting vehicle window meets the obstacle comprises:

detecting an operational parameter of the brushless direct current motor; and comparing the detected operational parameter of the brushless direct current motor against a preset threshold, and determining whether or not the lifting vehicle window meets the obstacle according to the relationship between the detected operational parameter of the brushless direct current motor and its corresponding threshold.

15. The vehicle window lift control method of claim 14, wherein feedback signals generated by a position sensing unit are square wave pulse signals, and a detected operating parameter is a width of pulses generated by the position sensing unit.

* * * * *